United States Patent [19]

Adrian et al.

[11] 4,408,723

[45] Oct. 11, 1983

[54] METHOD OF AND APPARATUS FOR THE TREATMENT OF PYRITE-CONTAINING MINERAL COAL

[75] Inventors: Fritz Adrian, Ratingen; Heinrich Sättler, Treis; Werner Sauerland, Voerde, all of Fed. Rep. of Germany

[73] Assignee: Steag Aktiengesellschaft, Essen, Fed. Rep. of Germany

[21] Appl. No.: 200,380

[22] Filed: Oct. 24, 1980

[30] Foreign Application Priority Data

Oct. 27, 1979 [DE] Fed. Rep. of Germany ..... 2943555

[51] Int. Cl.[3] ..... B02C 23/24

[52] U.S. Cl. ..... 241/19; 241/24

[58] Field of Search ..... 241/18, 24, 251, 52, 241/60, 80, 76, 77, 79.1, 19; 110/342, 220, 213, 224, 232; 122/4 D

[56] References Cited

U.S. PATENT DOCUMENTS 3,923,256 12/1975 Dörner ..... 241/76
3,982,699 9/1976 Jäzer ..... 241/14
4,059,060 11/1977 Gambs ..... 110/232
4,102,277 7/1978 Wall ..... 110/342
4,103,646 8/1978 Yerushalmi et al. ..... 122/4 D

*Primary Examiner*—Mark Rosenbaum
*Assistant Examiner*—Timothy V. Eley
*Attorney, Agent, or Firm*—Karl F. Ross; Herbert Dubno

[57] ABSTRACT

A method of and an apparatus for the treatment of mineral coal containing pyrite wherein the mined mineral product is milled, classified into a fine component and a coarse component, the coarse component is recycled and the coarse component in whole and in part is subjected to density suspension so that a light product consisting predominantly of coal is separated from a heavy product comprising the pyrite and mineral detritus. This latter product forms a combustible mixture which is subjected to fluidized bed combustion in the presence of lime to produce an exhaust gas which is used to fluidize the vibrating trough serving as the density separator and as the drying gas and entrainment gas for the mill. The solid residue consists of gypsum (calcium sulfate) and ash and can be used, e.g. in the mixture of cement or plastic, but in any event does not pose an environmental hazard.

2 Claims, 1 Drawing Figure

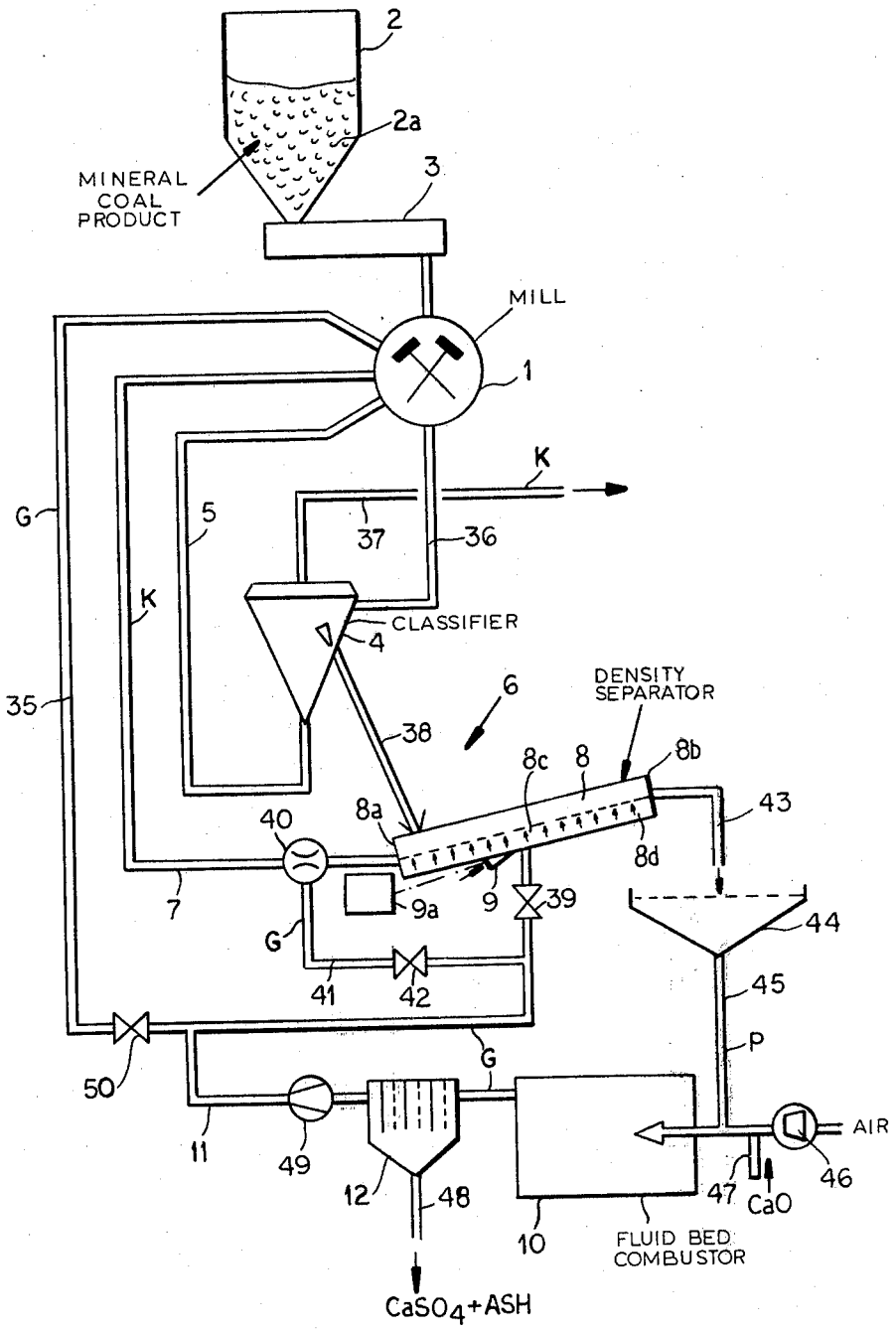
2
2a
MINERAL
COAL
PRODUCT
3
MILL
1
K
G
5
37
36
K
CLASSIFIER
4
6
DENSITY
SEPARATOR
35
38
8c
8
8b
43
40
8a
8d
7
9a
9
39
44
G
41
42
45
P
50
G
AIR
11
49
12
48
47
CaO
46
10
FLUID BED
COMBUSTOR
CaSO4+ASH

METHOD OF AND APPARATUS FOR THE TREATMENT OF PYRITE-CONTAINING MINERAL COAL

CROSS REFERENCE TO RELATED APPLICATION

This application is related to our concurrently filed copending commonly assigned application Ser. No. 200,379.

FIELD OF THE INVENTION

The present invention relates to an apparatus or plant for the treatment and handling of pyrite-containing mineral coal and, more particularly, to a method of and to an apparatus for the treatment of coal so as to avoid environmental hazard.

BACKGROUND OF THE INVENTION

Mined coal, being referred to as mineral coal, pit coal, hard coal and Steinkohle as is known, generally contains sulfur and mineral detritus. A portion of this sulfur is usually present in the form of pyrite (iron disulfide).

In power plants, boiling-firing application, gasification installations and the like, when mineral coal is used as a fuel, the coal is generally milled, classified to separate a fine component in the form of coal dust from a coarse component or gravel product containing larger pieces of coal to substantially all of the pyrite and a mineral detritus which may be present.

The coarse product is cycled to the mill and the coal dust is generally blown into a combustion chamber in ash stream.

Comminuted coal, produced in this manner, is especially effective for the firing of power plant boilers but also can be gasified, hydrogenated or utilized for other combustion purposes.

When the coal contains sulfur at least part of which is in the form of such pyrites, any combustion or gasification products will also contain sulfur unless the sulfur or pyrites have previously been removed.

Sulfur combustion products, namely sulfur oxides, can be generated in such combustion processes and pose a serious environmental danger because of their toxic, noxious and corrosive properties if vented to the atmosphere.

In many cases the combustion of high-sulfur coals is not permitted while in other cases such combustion is permitted but expensive energy-consuming methods must be used to remove the sulfur-containing components from the exhaust gas stream before it is vented to the atmosphere.

With some mineral coals, the problem is more pronounced than with others. For example in Ruhr Valley coal, some 40 to 60% by weight of the sulfur content of the mineral coal can be in the form of pyritic sulfur and pyrites themselves contain 50% and more sulfur by weight.

Generally the pyrite crystals are in a pure form embedded in or trapped in the coal and/or the coal and other mineral matter may be interlaced with or in the pyrite. A removal of pyrite from the mineral product can result in a substantial reduction in the sulfur content of the coal.

Various methods have been proposed to remove pyrite from coal. For example, it is known that subjecting the mined mineral product to high intensity magnetic fields will result in removal of pyrite, because of the magnetic properties of the latter, from the coal. These techniques are still under investigation and have not yet received widespread acceptance nor are they to be found in use on an industrial scale. Furthermore, they are not generally continuous and require relatively expensive equipment. This method also does not remove any other mineral detritus which may be present.

It is also known to eliminate the pyritic sulfur by transforming it to sulfuric acid but such techniques are environmentally unsound and dangerous. They also cannot be readily applied with lost cost apparatus which can be integrated into a conventional processing line for the coal.

Thus efforts to remove pyrites from coal in a practical way and on a larger scale have concentrated upon wet methods utilizing hydrocyclones and flotation methods or the like. These methods also allow recovery of different classes of coal for different purposes. Nevertheless even these methods have not been found to be practical in all cases especially when the coal, pyrite and mineral matter are interlaced and are intimately bound to one another.

OBJECTS OF THE INVENTION

It is the principal object of the present invention to provide an improved plant or apparatus for the handling of pyrite-containing coal in a completely environmentally sound and economical manner.

Another object of the invention is to provide an apparatus which can be readily integrated into conventional units for handling coal and which will allow elimination of pyritic sulfur which may be present in mineral coal.

Still another object of the invention is to provide a method of and an apparatus for the reduction of the sulfur content of coal which is thermodynamically and technologically compatible with earlier coal handling processes and apparatuses.

SUMMARY OF THE INVENTION

These objects and others which will become apparent hereinafter are attained, in accordance with the present invention, with an apparatus which comprises in the usual manner a mill for the dry milling of the mineral product in a milling gas stream, a classifier for the size separator of the milled product into a fine fraction or component and a coarse fraction or component (gravel product), the latter being a gravel product, and means for recycling the gravel product or coarse component to the mill.

According to the present invention the last mentioned means includes a separator for removing pyrite and mineral detritus on the one hand from entrained coal and on the other hand in the coarse or gravel product separated by the classifier, the separator operating in accordance with the densities of the components.

Advantageously, the density separator comprises an inclined vibrating trough with a perforated bottom or floor through which a fluidizing gas is introduced, this trough serving to separate the light product consisting predominantly of coal, from a heavy product which may contain pyrite mineral detritus and traces of coal.

According to the present invention the heavy product from the density separator is a combustionable mixture which is fed to a fluidized bed combustion chamber into which, in addition, the line is introduced so that gases and solid combustion products are produced. The gas product is an exhaust which is fed by an exhaust gas line from the combustion chamber to the fluidizing means for the trough and/or to the mill. The solid product is a mixture of gypsum (calcium sulfate) and ash which is environmentally safe and poses no problems with respect to disposal.

When the exhaust gas is produced in excess, any excess may be utilized in a manner other than that described. It may be introduced into the exhaust gas cleaner of a power plant.

To remove dust from the exhaust gas from the combustion chamber the exhaust gas duct may be provided with wet or dry dust removal means.

The invention is based upon our discovery that when a density separator is used with a combination of fluidization and inclined vibrating trough, the mixture of the heavy pyrite and any mineral matter which may be present tends to pass upwardly along the bottom of the trough because it is not fluidized by the light component while the light component is fluidized and held away from the bottom so that it tends to migrate downwardly.

The operating parameters of the inclined vibrating trough and the fluidizing device can be adjusted so that the pyrite and mineral mixture which passes upwardly and is removed from the trough to an upper outlet hereof can contain sufficient coal for effective combustion in the aformentioned chamber and a generation of the necessary temperature for transforming the pyrite sulfur to calcium sulfur and for production of the minimum exhaust gas quantity which is required.

While it is known to provide fluidized bed furnaces and combustion chambers and also to utilize lime in a combustion system for binding sulfur dioxide produced upon the combustion of sulfur-containing fuse it has not been recognized heretofore that one can control the coal contact by the vibrating trough density separator and also produce from the combustion the drying and fluidized gases utilized in the mill and/or the density separator.

The lime is preferably introduced in an amount at least stoichiometrically equal to the sulfur of the pyrite mineral matter fixture fed to the combustion chamber.

The system of the invention has been found to be extremely effective in reducing the sulfur content of mineral coal. It utilizes the fact that the density of the pyrite is about 5 grams per $cm^3$ while that of the mineral detritus is 2 to 2.5 grams per $cm^3$ and the coal, depending on its composition between 1.2 and 1.7 gram per $cm^3$.

The pyrite crystals are hard and are only milled with difficulty so that in the milling operation, with recycling, the pyrite content of the recycle progressively increases. The milling, in addition, breaks down the mineral structure in which pyrite, mineral detritus and coal are interlaced thereby freeing coal from the pyrite and vice versa.

This enrichment of pyrite in the recycle is parallel and by an enrichment in the cycle of mineral detritus such as quartz-containing components which are also difficult to mill because of their hardness.

Recycling is continued until the pyrite level in the recycled product is sufficient to make density separation economical and effective and depending upon the pyrite level, the appropriate provocation of the cycle is diverted to the density separator.

In cases of especially high pyrite content in the recycled gravel product all of the coarse component can be subjected to density separation.

An advantage of the present invention is that it can be carried out without exceptional additional cost since the mill and classifier are customarily provided in an installation at which comminuted coal is fired and only the fluidized bed combustion unit and the density separator need additionally be supplied.

Because the system of the invention removes pyrite from the recycled product, wear of the mill is reduced. The recovered pyrite is immediately converted in the plant to a product which has independent value or at least is environmentally satisfactory and safe.

The additional elements of the apparatus in the invention are readily integrated in power plant coal-processing equipment.

BRIEF DESCRIPTION OF THE DRAWING

The above and other objects, features and advantages of the present invention will become more readily apparent from the following description reference being made to the accompanying drawing in which the sole FIGURE is a flow diagram illustrating an apparatus or plant in accordance with the invention.

SPECIFIC DESCRIPTION

The plant shown in the drawing comprises a mill 1, e.g. hammermill, to which the raw mined product (mineral coal 2*a*) is fed from a hopper 2 via a feeder 3 which can be of the screw conveyor type.

In the mill 1, in which the material to be comminuted is milled in a hot gas stream, the coal tends to be broken up more readily than the pyrite crystals and other mineral detritus.

The milling gas stream is fed to the mill 1 via a line 35 and its path is represented at G. The temperature of the milling gas will depend upon the milling process requirement and can be controlled or regulated in the manner described in the aforementioned copending application.

The comminuted or mill product is delivered via line 36 to a classifier 4, operating as a classifying cyclum, the fines consisting predominantly of coal K are carried in the gas stream via the line 37 and can feed a boiler combustion chamber for producing steam in a power plant as described in the aforementioned application.

Coarse component is recycled to the mill via the line 4 pneumatically conveyed by the gas stream.

The classifier 4 thus separates a fine component consisting predominantly of coal from a coarse component or gravel product which is recycled and which consists of fine pyrite crystals P, mineral detritus and large particles or pieces of coal.

When the recirculation has progressed for a sufficient length of time to allow the pyrite contact in the cycle to build up, line 38 taps all or a portion of the coarse component from the cycle path and delivers it to a density separator 6 which separates this coarse component into a light product migrating to the lower end 8*a* of the inclined vibrating trough 8 and a heavy product migrating to the upper end 8*b* of the trough.

The inclined vibrating trough 8 has a perforated bottom 8*c* closing a plenum 8*d* to which fluidizing gas is supplied at a rate controlled by a valve 39, the vibrator for the trough being indicated at 9.

The coarse component delivered to the trough is so fluidized that the light product is in suspension and can migrate downwardly while the heavy product rides on the floor 8*c* of the trough and is carried upwardly by the vibrating movement.

By varying the frequency and the amplitude at the controller 9*a* for the vibrator 9 and the velocity of the fluidizing gas stream, the proportion of coal in the heavy product can be increased or reduced.

While the light product, consisting predominantly of coal, is drawn from the bottom of the trough and recycled to the mill 1 via line 7, e.g. through a venturi nozzle 40 supplied with gas via line 41 and a valve 42, the heavy product consisting of a controlled quantity of coal, substantially all of the pyrite and substantially all of the mineral detritus is led from the upper end of the trough at 43 and is subjected to a sifting at 44 with predominantly pyrite and coal passing via line 45 5o a fluidized bed furnace 10. Air can be supplied as shown at 46 by a blower.

The line 47 adds lime to the combustible mixture and the solid combustion products, entrained with the gas, are subjected to filtration at 12 and removed as gypsum and ash at 48. The hot gas, freed from the solid combustion product is fed by a blower 49 and the line 11 to line 35 and is distributed as controlled by valves 39, 42 and 50 to the fluidizing means of the vibrating trough, the coal-entraining stream delivered to the mill and the milling and drying gas.

The particle remover 12 can be operated as a wet or dry particle or dust separator.

We claim:

1. A method of treating mineral coal containing pyrite which comprises the steps of:

(a) milling a mineral coal product containing pyrite and mineral detritus in the presence of a gas stream to form a fine component consisting predominantly of coal and a coarse component comprising pyrite, mineral detritus and coal;

(b) classifying the milled product step (a) to separate said fine component from said coarse component;

(c) subjecting said coarse component to a density separation on a vibrating trough while fluidizing same on said trough with a gas stream to produce a light product consisting predominantly of coal and a heavy product in the form of a combustible mixture of pyrite, coal and mineral detritus;

(d) burning said combustible mixture in the presence of lime to produce a gas and an environmentally safe solid residue consisting essentially of gypsum and ash; and (e) feeding the gas produced in step (d) to at least one of steps (a) and (c) as the respective gas stream thereof.

2. The method defined in claim 1, further comprising the step of controlling the proportion of coal in said mixture by adjusting the fluidizing gas stream velocity and the vibrating frequency and amplitude of said trough.

* * * * *